US007931123B2

(12) United States Patent
Moldthan et al.

(10) Patent No.: US 7,931,123 B2
(45) Date of Patent: Apr. 26, 2011

(54) STEPLADDER FOLDING TWIN-STEP

(75) Inventors: Jason R. Moldthan, Hadley, PA (US); Thomas W. Parker, Jamestown, PA (US); Jack Warren Gee, II, Willoughby, OH (US); David Andrew Winslow, Hermitage, PA (US); Kyle G. Astor, Conneaut Lake, PA (US); Timothy James Brookbank, Girard, OH (US)

(73) Assignee: Werner Co., Greenville, PA (US)

( * ) Notice: Subject to any disclaimer, the term of this patent is extended or adjusted under 35 U.S.C. 154(b) by 750 days.

(21) Appl. No.: 10/990,611

(22) Filed: Nov. 17, 2004

(65) Prior Publication Data

US 2006/0102425 A1 May 18, 2006

(51) Int. Cl.
*E06C 5/32* (2006.01)

(52) U.S. Cl. ..... 182/129; 182/161; 182/165

(58) Field of Classification Search ..... 182/129, 182/165, 161, 180.1, 22
See application file for complete search history.

(56) References Cited

U.S. PATENT DOCUMENTS

| | | | | | |
|---|---|---|---|---|---|
| 523,709 | A * | 7/1894 | Leach | 182/123 |
| 2,470,053 | A * | 5/1949 | Salisbury | 182/25 |
| 2,957,542 | A * | 10/1960 | Rizzuto | 182/129 |
| 3,127,953 | A * | 4/1964 | Shore | 182/106 |
| 3,303,906 | A * | 2/1967 | Bouwmeester et al. | 182/161 |
| 3,768,592 | A * | 10/1973 | Higgins | 182/22 |
| 4,191,397 | A * | 3/1980 | Kassai | 280/647 |
| 4,276,955 | A * | 7/1981 | Hickman | 182/33 |
| 4,560,030 | A * | 12/1985 | Mucelli | 182/118 |
| 4,648,481 | A * | 3/1987 | Lee | 182/28 |
| 5,577,574 | A * | 11/1996 | Joseph | 182/180.1 |
| 5,722,507 | A * | 3/1998 | Kain | 182/129 |
| 6,012,548 | A * | 1/2000 | Kim | 182/165 |
| 6,454,050 | B2 * | 9/2002 | Gibson et al. | 182/161 |
| 7,100,739 | B2 * | 9/2006 | Parker et al. | 182/165 |
| 7,128,187 | B2 * | 10/2006 | Simpson | 182/129 |

* cited by examiner

*Primary Examiner* — Alvin C Chin-Shue
(74) *Attorney, Agent, or Firm* — Ansel M. Schwartz

(57) ABSTRACT

A ladder includes a first section having at least one step. The ladder includes a second section having a least one step. The ladder includes a platform attached to the first and second sections. The ladder includes a hinge mechanism connected to the first section and second section, about which the first section and second section move between an open state, where the first and second sections are in an angular relationship for use, and a folded state where the first and second sections and the platform are essentially in parallel, as shown in FIGS. 4 and 5.The ladder includes a foldable tray mechanism attached to the hinge mechanism about which the foldable tray mechanism moves between the open state independently of the first and second sections, where the foldable tray is in an angular relationship with the first and second sections for use, and a folded state where the foldable tray essentially forms a plane with the first section. A hinge for a stepladder. A step to a ladder. Methods for using a stepladder.

6 Claims, 6 Drawing Sheets

STEPLADDER FOLDING TWIN-STEP

FIELD OF THE INVENTION

The present invention is related to a folding stepladder having steps on its front side and its back side, and a foldable tray mechanism. More specifically, the present invention is related to a folding stepladder having steps on its front section and its back section, and a foldable tray mechanism where the foldable tray mechanism can be moved independently of the front and back sections.

BACKGROUND OF THE INVENTION

Stepstools are very useful in the home or work allowing users to reach areas that would otherwise be unreachable, whether the intent is to access storage cabinets, do cleaning, change light bulbs, etc. Some tasks though require more than one person at a time. Normally, you would use a step stool for one of the people and a chair or other stool for the other person or a two-sided ladder can be used. The two-sided ladder is fine and has been used for years for these tasks.

SUMMARY OF THE INVENTION

The present invention pertains to a ladder. The ladder comprises a first section having at least one step. The ladder comprises a second section having a least one step. The ladder comprises a platform attached to the first and second sections. The ladder comprises a hinge mechanism connected to the first section and second section, about which the first section and second section move between an open state, where the first and second sections are in an angular relationship for use, and a folded state where the first and second sections and the platform are essentially in parallel, as shown in FIGS. 4 and 5. The ladder comprises a foldable tray mechanism attached to the hinge mechanism about which the foldable tray mechanism moves between the open state independently of the first and second sections, where the foldable tray is in an angular relationship with the first and second sections for use, and a folded state where the foldable tray essentially forms a plane with the first section.

The present invention pertains to a hinge for a stepladder having a foldable tray mechanism. The hinge comprises a handle, which when compressed, allows the foldable tray mechanism to move to the folded state. The hinge comprises means for connecting with a first front rail and first real rail of the ladder and a first rail of the foldable tray.

The present invention pertains to a ladder. The ladder comprises a first section having at least one step. The ladder comprises a second section having at least one step. The ladder comprises a platform attached to the first and second sections. The ladder comprises a hinge mechanism connected to the first section and second section, about which the first section and second section move between an open state, where the first and second sections are in an angular relationship for use, and a folded state where the first and second sections and the platform are essentially in parallel. The ladder comprises a linkage mechanism connected to the platform and the step of each section wherein when the platform is moved to a folded state, the steps are moved into the folded state, and when the platform is moved to an open state, the steps are moved into the open state.

The present invention pertains to a method for using a stepladder. The method comprises the steps of moving a first section of the stepladder having a least one step and a second section of the stepladder having at least one step into an open state, where the first and second sections are in an angular relationship for use, about a hinge mechanism of the stepladder connected to the first section and second section. There is the step of moving a foldable tray mechanism of the stepladder, attached to the hinge mechanism about which the foldable tray mechanism moves, independently of the first and second sections to a desired position.

The present invention pertains to a method for using a stepladder. The method comprises the steps of compressing a handle of the hinge of the stepladder which allows a foldable tray mechanism of the stepladder to move up to a folded state. There is the step of folding a first section of the stepladder and a second section of the stepladder about the hinge into a folded state, independently of the foldable tray mechanism.

The present invention pertains to a method for using a stepladder. The method comprises the steps of grabbing a platform of the stepladder attached to a first section of the stepladder having at least a first step and a second section of the stepladder having a least a second step, which are in an open state. There is the step of pulling the platform up into a folded state causing a linkage mechanism connected to the platform and the step of each section to move the steps into the fold state.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
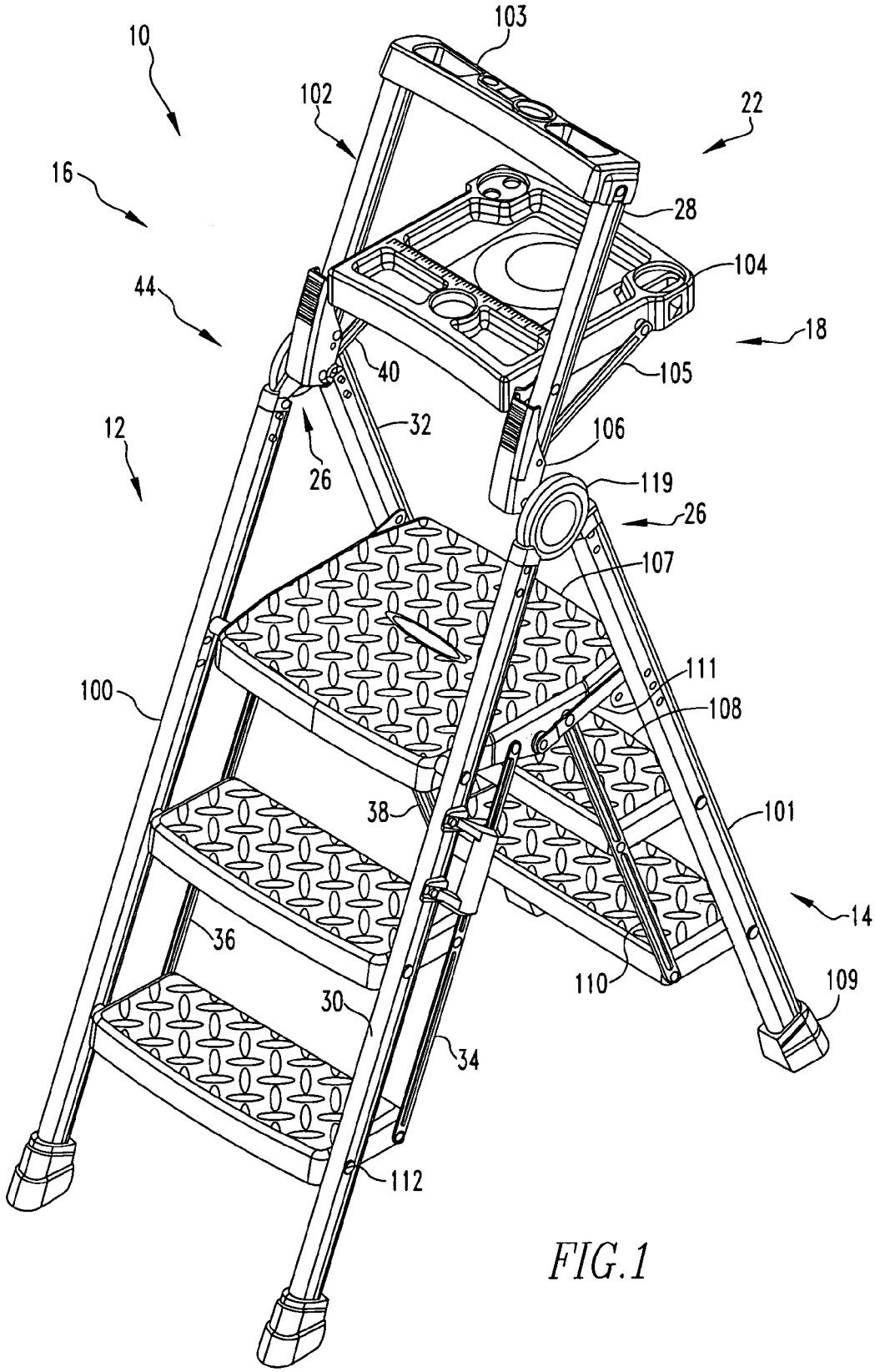
FIG. 1 is a perspective view of the ladder of the present invention.
Figure 2:
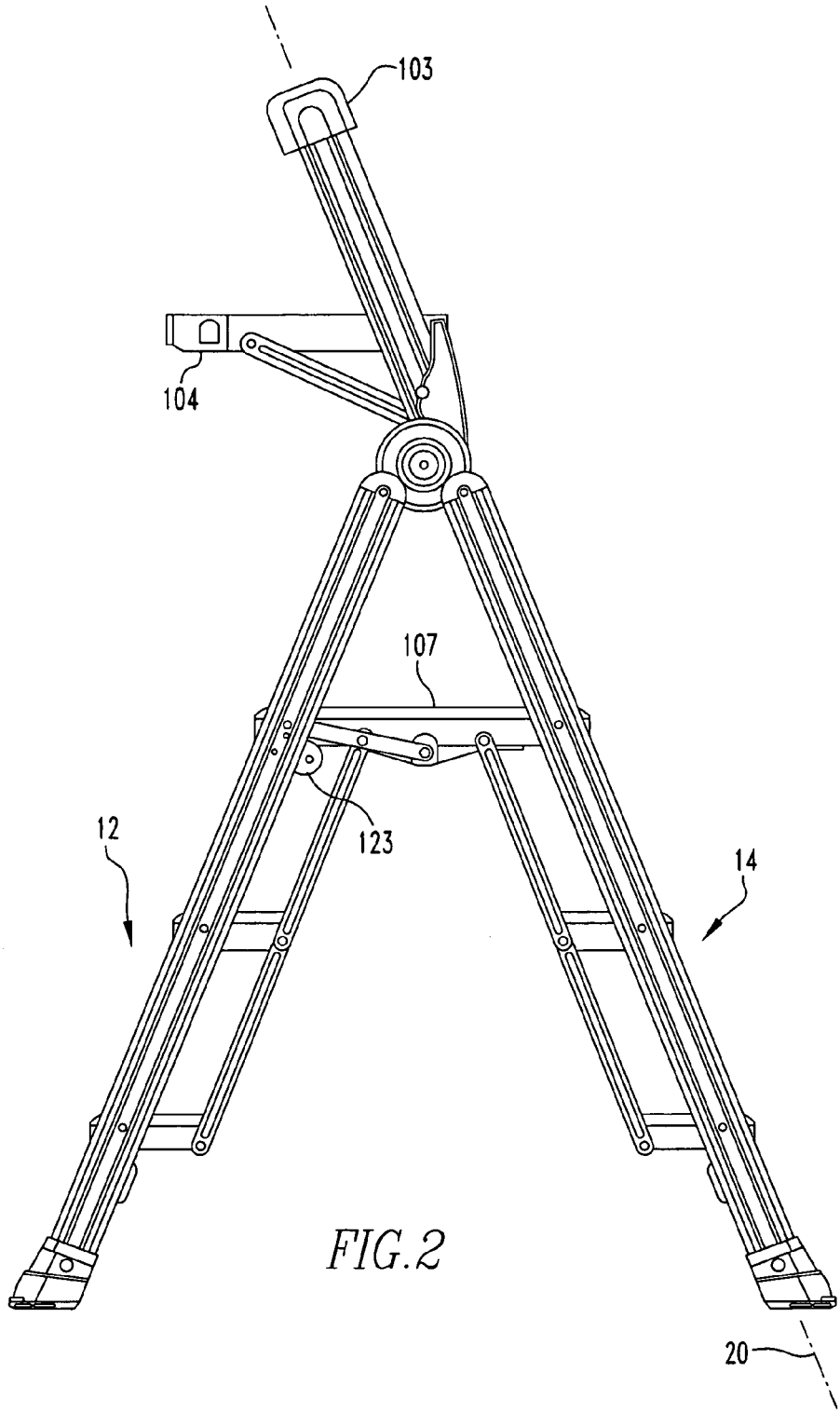
FIG. 2 is a side view of the ladder with the first section and second section and the foldable tray mechanism in an open state.
Figure 3:
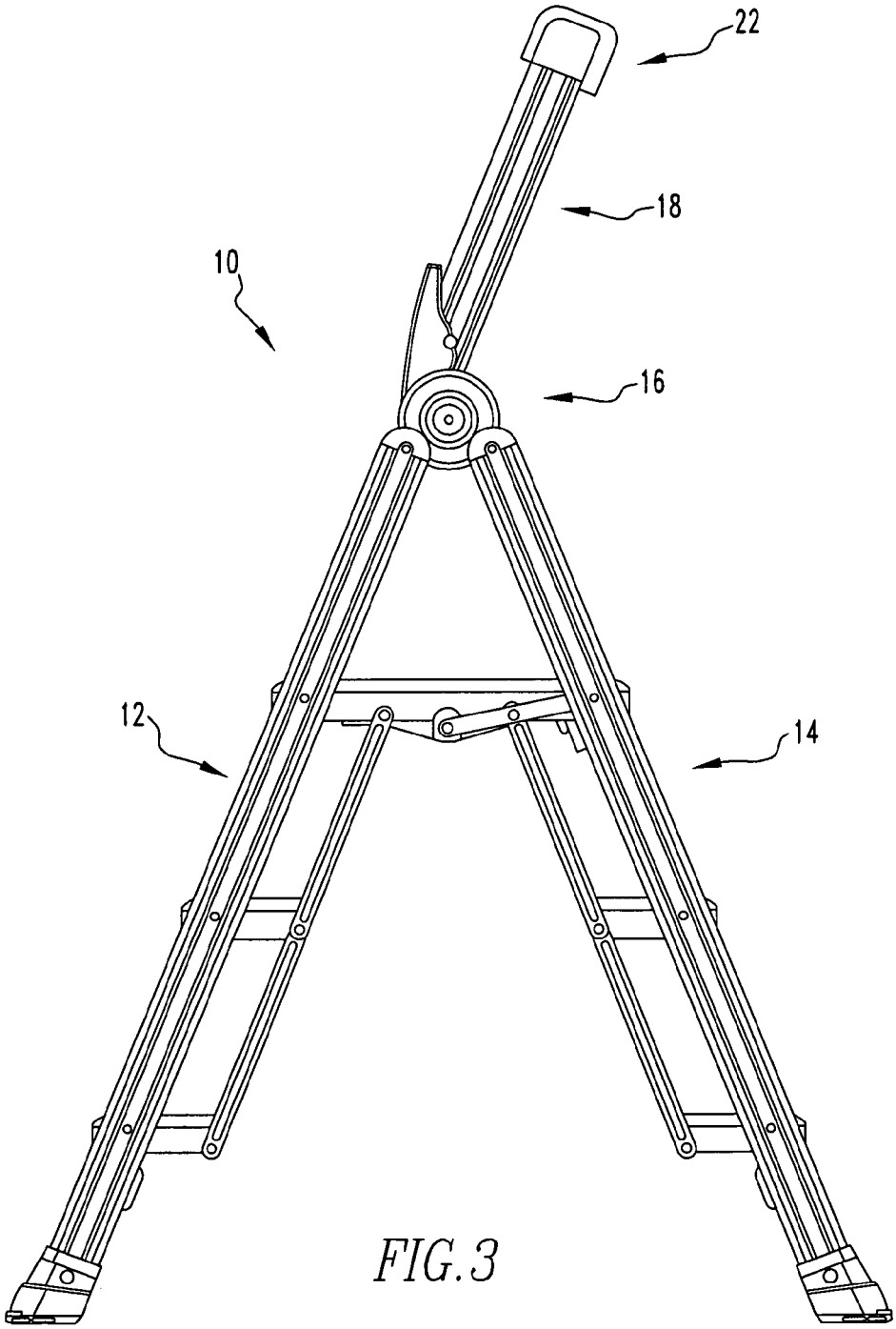
FIG. 3 is a side view of the first section and second section in an open state and the foldable tray mechanism in a folded state.
Figure 5:
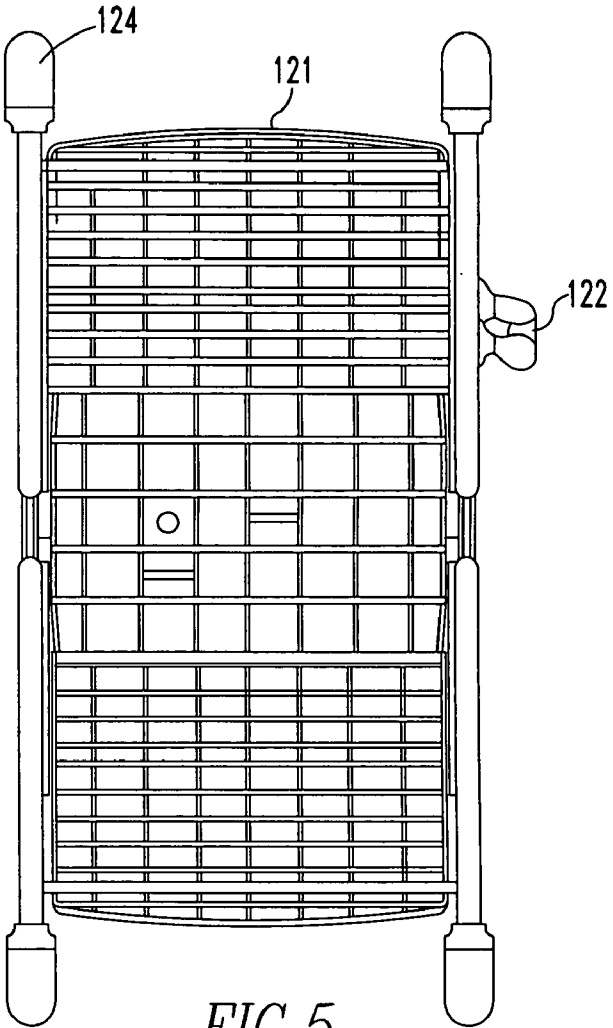
FIGS. 4 and 5 are front and rear views, respectively, of the first section and second section and foldable tray mechanism in a folded state.
Figure 4:
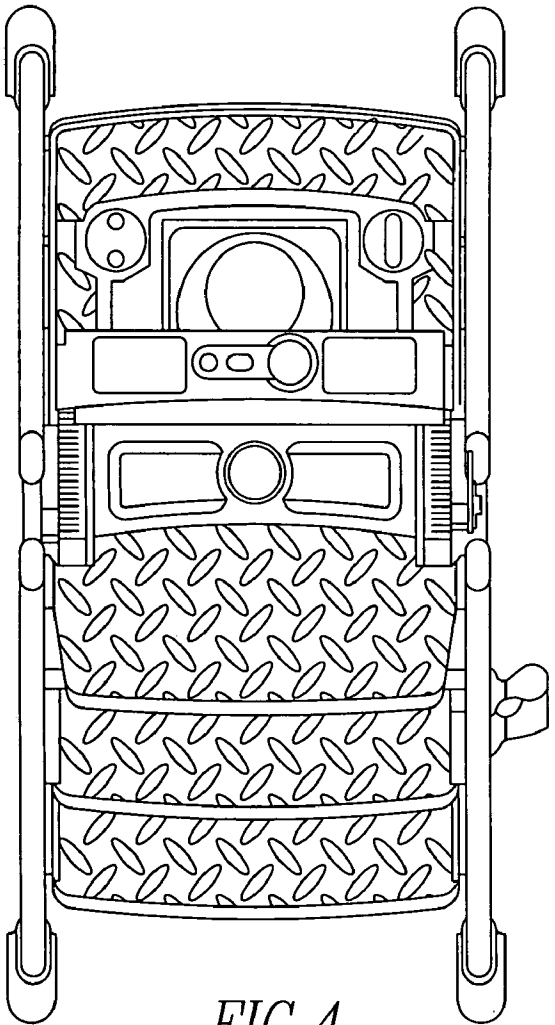
Figure 6:
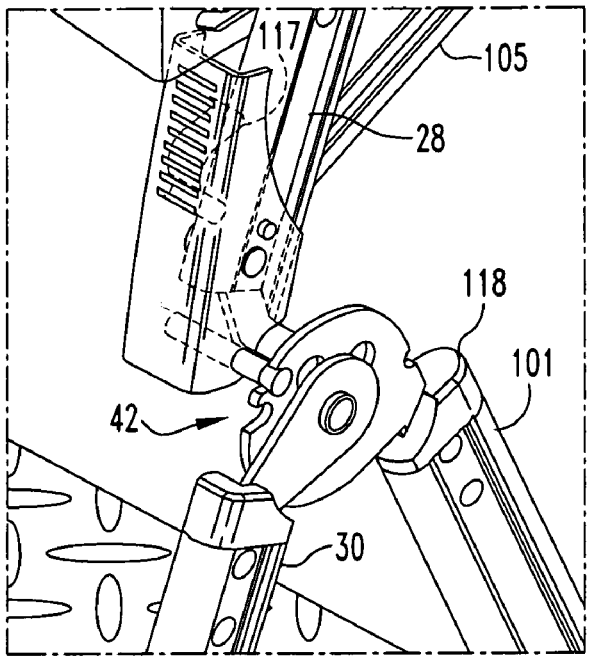
FIGS. 6 and 7 are perspective views of a hinge of the ladder.
Figure 7:
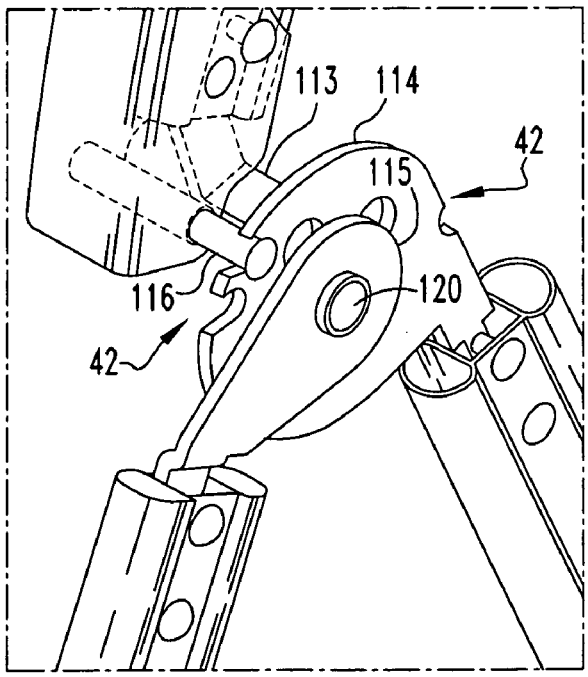
Figure 8:
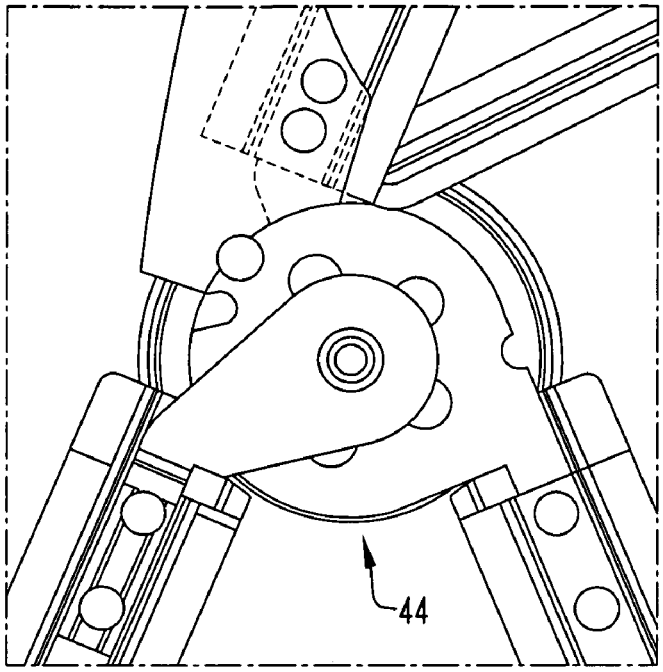
FIGS. 8 and 9 are side views of the hinge of the ladder.
Figure 9:
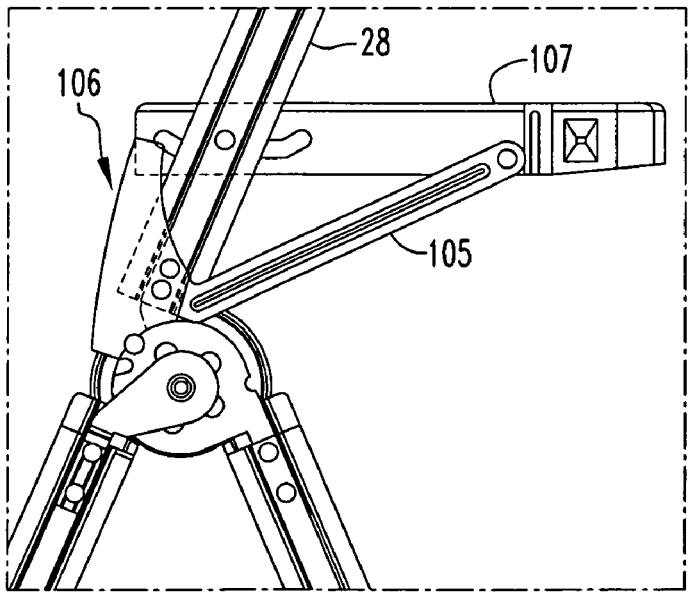

Referring now to the drawings wherein like reference numerals refer to similar or identical parts throughout the several views, and more specifically to FIG. 1 thereof, there is shown a ladder 10, such as a step stool. The ladder 10 comprises a first section 12 having at least one step 108. The ladder 10 comprises a second section 14 having a least one step 108. The ladder 10 comprises a platform 107 attached to the first and second sections 12, 14. The ladder 10 comprises a hinge mechanism 16 connected to the first section 12 and second section 14, about which the first section 12 and second section 14 move between an open state, where the first and second sections 12, 14 are in an angular relationship for use, as shown in FIGS. 2 and 3, and a folded state where the first and second sections 12, 14 and the platform 107 are essentially in parallel, as shown in FIGS. 4 and 5. The ladder 10 comprises a foldable tray mechanism 18 attached to the hinge mechanism 16 about which the foldable tray mechanism 18 moves between the open state independently of the first and second sections 12, 14, where the foldable tray is in an angular relationship with the first and second sections 12, 14 for use, and a folded state where the foldable tray essentially forms a plane 20 with the first section 12.

Preferably, the ladder 10 includes a second tray mechanism 22 that extends from the hinge mechanism 16. The second tray mechanism 22 is preferably fixed in place relative to the first section 12. Preferably, the hinge mechanism 16 includes a first hinge 24 and a second hinge 26. The second tray mechanism 22 preferably includes a first rail 28 and a second rail 102 extending from the first hinge 24 and the second hinge 26 and a fixed tray 103 connected to the first rail 28 and the second rail 102.

Preferably, the first section 12 has a first front rail 30 and a second front rail 100 connected to the first hinge 24 and second hinge 26, respectively, and the second section 14 has a first rear rail 101 and a second rear rail 32 connected to the first hinge 24 and the second hinge 26, respectively, the first section 12 includes a first front link 34 and a second front link 36 connected to the first section 12 step 108 and the platform 107, and the first and second front rails, respectively; and the second section 14 includes a first rear link 110 and a second rear link 38 connected to the second section 14 step 108 and the platform 107, and the first and second rear rails, respectively; the first and second front links and the first and second rear links fold into the folded state and open into the open state with the first and second sections 12, 14. The foldable tray mechanism 18 preferably includes a first tray 104, a first tray support hinge 105 and a second tray support hinge 40 connected to the first rail 28 and second rail 102, respectively, and the first tray 104.

Preferably, the first tray 104 locks in the folded state to the first rail 28 and second rail 102. The first and second hinges 24, 26 preferably each comprise a handle 106, which when compressed, allows the foldable tray mechanism 18 to move to the folded state, as shown in FIGS. 6-9. Preferably, each hinge includes a bushing 120 and a first plate 115, a second plate 114 and a third plate 113 that are held by the bushing 120 and rotate about the bushing 120.

The first plate 115 preferably has a plurality of depressions 42 and each hinge includes a pin 116 attached to the handle 106 that fits into one of the plurality of the depressions 42 to place the foldable tray in an open state or a folded state depending on which one of the plurality of depressions 42 the pin 116 is disposed.

Preferably, compression of the handle 106 allows the pin 116 to move between depressions 42. When the foldable tray is in the closed state, the pin 116 preferably moves to a depression corresponding to the open state without the handle 106 having to be compressed. Preferably, the first plate 115 of the first hinge 24, the second plate 114 of the first hinge 24, and the third plate 113 of the first hinge 24 connect with the first front rail 30, first rear rail 101, and first rail 28, respectively.

The present invention pertains to a hinge for a stepladder having a foldable tray mechanism 18. The hinge comprises a handle 106, which when compressed, allows the foldable tray mechanism 18 to move to the folded state. The hinge comprises means for connecting with a first front rail 30 and first real rail of the ladder 10 and a first rail 28 of the foldable tray.

Preferably, the connecting means 44 includes a bushing 120 and a first plate 115, a second plate 114 and a third plate 113 that are held by the bushing 120 and rotate about the bushing 120. The first plate 115 preferably has a plurality of depressions 42 and the hinge includes a pin 116 attached to the handle 106 that fits into one of the plurality of the depressions 42 to place the foldable tray in an open state or a folded state depending on which one of the plurality of depressions 42 the pin 116 is disposed.

Preferably, compression of the handle 106 allows the pin 116 to move between depressions 42. When the foldable tray is in the closed state, the pin 116 preferably moves to a depression corresponding to the open state without the handle 106 having to be compressed. Preferably, the first plate 115, the second plate 114, and the third plate 113 connect with the first front rail 30, first rear rail 101, and first rail 28, respectively.

The present invention pertains to a ladder 10. The ladder 10 comprises a first section 12 having at least one step 108. The ladder 10 comprises a second section 14 having a least one step 108. The ladder 10 comprises a platform 107 attached to the first and second sections 12, 14. The ladder 10 comprises a hinge mechanism 16 connected to the first section 12 and second section 14, about which the first section 12 and second section 14 move between an open state, where the first and second sections 12, 14 are in an angular relationship for use, and a folded state where the first and second sections 12, 14 and the platform 107 are essentially in parallel. The ladder 10 comprises a linkage mechanism connected to the platform 107 and the step 108 of each section wherein when the platform 107 is moved to a folded state, the steps 108 are moved into the folded state, and when the platform 107 is moved to an open state, the steps 108 are moved into the open state.

The present invention pertains to a method for using a stepladder. The method comprises the steps of moving a first section 12 of the stepladder having a least one step 108 and a second section 14 of the stepladder having at least one step 108 into an open state, where the first and second sections 12, 14 are in an angular relationship for use, about a hinge mechanism 16 of the stepladder connected to the first section 12 and second section 14. There is the step of moving a foldable tray mechanism 18 of the stepladder, attached to the hinge mechanism 16 about which the foldable try mechanism moves, independently of the first and second sections 12, 14 to a desired position.

The present invention pertains to a method for using a stepladder. The method comprises the steps of compressing a handle 106 of the hinge of the stepladder which allows a foldable tray mechanism 18 of the stepladder to move up to a folded state. There is the step of folding a first section 12 of the stepladder and a second section 14 of the stepladder about the hinge into a folded state, independently of the foldable tray mechanism 18.

The present invention pertains to a method for using a stepladder. The method comprises the steps of grabbing a platform 107 of the stepladder attached to a first section 12 of the stepladder having at least a first step 108 and a second section 14 of the stepladder having a least a second step 108, which are in an open state. There is the step of pulling the platform 107 up into a folded state causing a linkage mechanism connected to the platform 107 and the step 108 of each section to move the steps 108 into the fold state.

In the operation of the invention, the folding twin-step stool of the present invention is unique in several ways:

It is based off of a step stool project ladder. Thus, it has enclosed aluminum rails for comfort to the hand. It has folding steps that allow for a larger standing area than a regular twin ladder but the steps 108 fold up when closed to minimize depth for storage.

The top section of a regular twin ladder has a support bar going across to hold. The new twin step stool has two trays on top. One acts as a support between the top rails as well as having caddies for small items, a drill chuck hole and a couple screw driver holes. The second tray is a fold-away tray that is used when the stool is being used by one or two people. This tray has three positions, fully closed to allow two people to use the stool at the same time, a vertical rail position that would allow two people to have more limited use but provides a large surface to hold paint cans, bottles, cleaning items, etc. The last position would be for one person to basically use this stool as a single sided stool having full access to the platform 107 and both trays.

The hinged foldable tray mechanism 18 operates independently of the opening & closing of the stool. This is different than most project step stools as well as most if not all twin ladders. There is a handle 106 on each side of the stool just above the first and second hinges 24, 26. The handle 106 is held in the open position by an extension spring 117. When both handles 106 are compressed by hand each handle 106 releases an attached pin 116 from each hinge. This release allows the foldable tray mechanism 18 to rotate around a bushing 120 that holds three hinge plates 113, 114, 115 together. The two hinge plates, first 115 and second 114, are used in the opening and closing of the stool. There are three positions for the foldable tray mechanism 18 to be fixed in: vertical to ground, parallel to first section 12 and closed. The vertical and parallel to first section 12 angle are used in the aforementioned uses. The closed angle is only used when the stool is closed. The compact position is another advantage to using this twin stool.

When closing the stool, the user pulls the platform 107 toward him. As the platform 107 is closing, a set of linkages 34, 36 on the first section 12 and a separate set of linkages 110, 38 on the second section 14, both attached to the platform 107, are connected to that sides lower steps 108 pull all of the steps 108 from a horizontal standing surface to a vertical standing surface. A spreader 111 is positioned between the platform 107 and the second section 14. The spreader 111 pulls the second section 14 toward the first section 12. The steps 108, on both the first and second sections 12, 14, in the closed position are parallel to each other. Once the first and second sections 12, 14 are closed, the foldable tray mechanism 18 can be closed to the compact position by compressing the handles 106 located near the hinges. The foldable tray mechanism 18 rotates away from the user and folds into the second section 14. The first tray 104 and platform 107 nest near each other and the fixed tray 103 rests in between the platform 107 and the second step. While in the compact position, the pin 116 attached to the handle 106 is sitting in a unshaped depression on the first hinge 24 plate 115. This unshaped depression is smaller than the other two depressions 42 and has a curved edge. This allows the foldable tray mechanism 18 to be resistively stuck in the compact position. The advantage is the fact that the user does not have to compress the handles 106 to allow the foldable tray mechanism 18 to fold out into one of the used positions. A small pulling force allows the handle release pins 116 to snap out of the shallow depression. As the pin 116 approaches the center of the other two positions, the pin 116 is forced into the larger depressions 42 by the spring force mentioned above. The sharp edges and deeper depressions 42 of the other two positions allow for a positive lock by the pins 116 into these depressions 42.

The first tray 104 on the foldable tray mechanism 18 has two unique features that magnify the multi-positional foldable tray mechanism 18 as well as the compact position. The first feature is the ability to keep the first tray 104 horizontal in both of the operating positions and the fully closed position by simply lifting and sliding the first tray 104 to the proper position. The other feature is the self-locking of the first tray 104 in the fully closed position. The first tray 104 has a boss on either side of the first tray 104 that snaps into the second rail 102 groove when positioned. This feature reduces complexity and part count. It also allows the user to use or not use the first tray 104 whenever desired. Most other project ladders and stools have a dependent tray that opens with the stool and closes with the stool; the user has no options (except for the forced removal of the tray).

The stool, in an opened position, is supported from slipping by foot pads 124 that are fitted to the bottom of the foot 109. In the closed position, the lowest part of the feet are even vertically between the front and rear set. This allows the stool to stand alone in a vertical position.

During opening & closing of the stool, the platform 107 and steps 108 are rotated about a support 121 that is placed toward the front of each of the steps 108 and platform 107. The second front rail 100 and first rear rail 101 have holes that trap the shape of the support 121 so as not to rotate in the rails 100 and 101.

The first tray 104 has a groove toward the front of the stool that allows adjustment of position depending on the top section use or placement. This groove allows the first tray 104 to be folded into a shorter top section than with conventional trays. The groove allows the tray 104 to follow a shallower arc when folding because the front is allowed to drop down.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A ladder comprising:

a first section having at least one step;

a second section having a least one step;

a platform attached to the first and second sections;

a hinge mechanism connected to the first section and second section, about which the first section and second section move between an open state, where the first and second sections are in an angular relationship for use, and a folded state where the first and second sections and the platform are essentially in parallel, the platform disposed below the hinge mechanism and above each step of the first and second sections when the first and second sections are in the open state, the hinge mechanism includes a first hinge and a second hinge;

a first rail extending from the first hinge of the hinge mechanism and separate and apart from the first section and second section with the hinge mechanism disposed between the first rail and the first and second sections;

a second rail extending from the second hinge of hinge mechanism and separate and apart from the first section and second section with the hinge mechanism disposed between the second rail and the first and second sections, the first rail and second rail rotatably attached to the hinge mechanism; and a foldable tray mechanism attached to the first rail and second rail attached to the hinge mechanism about which the foldable tray mechanism moves between an open state of the foldable tray mechanism independently of the first and second sections, where the foldable tray mechanism is in an angular relationship with the first and second sections for use, and a folded state of the foldable tray mechanism where the foldable tray mechanism essentially forms a plane with the first section, the foldable tray mechanism disposed above the hinge mechanism when the foldable tray mechanism and the first and second sections are in the open state, the foldable tray mechanism includes a first tray, a first tray support hinge and a second tray support hinge connected to the first rail and second rail, respectively, and the first tray; the first and second hinges each comprise a handle, which when compressed, allows the first rail and the second rail to move to the folded state from the open state of the foldable tray mechanism, each hinge includes a bushing and a first plate, a second plate and a third plate that are held by the bushing and rotate about the bushing, the second plate has a plurality of depressions and each hinge includes a pin attached to the handle that fits into one of the plurality of the depressions to place the foldable tray mechanism in its open state or in its folded state depending on which one of the plurality of depressions the pin is disposed, compression of the handle allows the pin to move between depressions, when the foldable tray mechanism is in its folded state, the pin is able to move to a depression corresponding to the open state of the foldable tray mechanism without the handle having to be compressed.

2. A ladder as described in claim 1 including a second tray mechanism that extends from the hinge mechanism.

3. A ladder as described in claim 2 wherein the second tray mechanism includes the first rail and the second rail extending from the first hinge and the second hinge, respectively, and a second tray connected to the first rail and the second rail.

4. A ladder as described in claim 3 wherein the first section has a first front rail and a second front rail connected to the first hinge and second hinge, respectively, and the second section has a first rear rail and a second rear rail connected to the first hinge and the second hinge, respectively, the first section includes a first front link and a second front link connected to the first section step and the platform, and the first and second front rails, respectively; and the second section includes a first rear link and a second rear link connected to the second section step and the platform, and the first and second rear rails, respectively; the first and second front links and the first and second rear links fold into the folded state and open into the open state when the first and second sections move into the folded state or the open state, respectively.

5. A ladder as described in claim 4 wherein the first tray when in the folded state, locks to the first rail and second rail.

6. A ladder as described in claim 4 wherein the first plate of the first hinge, the second plate of the first hinge, and the third plate of the first hinge connect with the first front rail, first rear rail, and first rail, respectively.

* * * * *